US005614483A

United States Patent [19]

Fessenbecker et al.

[11] Patent Number: 5,614,483

[45] Date of Patent: Mar. 25, 1997

[54] STABILIZED LUBRICANT BASE MATERIAL

[75] Inventors: Achim Fessenbecker, Heidelberg; Joachim Korff, Hockenheim; Hans-Jürgen Kress, Brühl; Volker Müller, Oftersheim, all of Germany

[73] Assignee: Rhein Chemie Rheinau GmbH, Mannheim, Germany

[21] Appl. No.: 534,703

[22] Filed: Sep. 27, 1995

[30] Foreign Application Priority Data

Oct. 5, 1994 [DE] Germany ..... 44 35 548.3

[51] Int. Cl.[6] ..... C10M 133/22

[52] U.S. Cl. ..... 508/550

[58] Field of Search ..... 252/50; 508/550; C10M 133/22

[56] References Cited

U.S. PATENT DOCUMENTS

| | | | |
|---|---|---|---|
| 2,878,181 | 3/1959 | Ayers et al. | 308/263 |
| 3,193,522 | 7/1965 | Neumann et al. | 252/50 X |
| 3,346,496 | 10/1967 | Neumann et al. | 252/50 |
| 4,490,266 | 12/1984 | Hentschel et al. | 252/49.8 |

FOREIGN PATENT DOCUMENTS 9421759 9/1994 WIPO .

*Primary Examiner*—Prince Willis, Jr.
*Assistant Examiner*—Cephia D. Toomer
*Attorney, Agent, or Firm*—Connolly and Hutz

[57] ABSTRACT

Lubricant base materials containing ester groups may be stabilised by adding a small quantity of carbodiimides and the service life of lubricants manufactured therefrom may be decisively extended.

1 Claim, No Drawings

STABILIZED LUBRICANT BASE MATERIAL

A range of lubricant base materials, for example natural triglycerides, synthetic carboxylic acid esters, phosphoric acid triesters, olefin/dicarboxylic acid copolymers and silicone oils are hydrolytically attacked by water to form acidic breakdown products and alcohols. These acidic breakdown products are a measure of the degree of decomposition. They may thus be stated quantitatively as an acid value, such that this acts as a measure of the ageing condition of the lubricant base materials (the acid value is the quantity of KOH in mg required to neutralise 1 g of material).

The presence of acids or acidic breakdown products accelerates hydrolysis autocatalytically. Since water is always present in at least small quantities under industrial conditions, the service life of lubricants based on such lubricant base materials containing ester groups is limited.

It has not hitherto proved possible to overcome this decisive disadvantage of lubricant base materials containing ester groups by means of additive. It was also thought that this was not even possible due to the nature of the ester bond. Attempts have been made to reduce the initial acid content of such materials by particular purification processes. However, such measures merely initially retard degradation. Long-chain, oil soluble amines have also been added, which react with the acids contained or arising in the base materials to form salts. However, these salts very readily dissociate (for example they are included in the determination of the acid value), such that the acidic contaminants (essentially carboxylate ions) are not permanently removed from the preparation.

This invention is based on the recognition that adding 0.05 to 5 wt.%, preferably 0.1 to 3 wt.% of a carbodiimide soluble therein to a lubricant base material containing ester groups effectively prevents hydrolytic decomposition. Carbodiimides react both with acids, for example the breakdown products of the lubricant base material containing ester groups, and with water. In both cases, stable urea derivatives are formed. The reaction with the acidic constituents is rapid, that with water very slow. Acidic constituents present or arising in the material are thus permanently removed, as is any water entering the product.

Carbodiimides have hitherto been used to stabilise thermoplastics. However, after being shaped a single time, these are usually in the form of solid, unchanging mouldings, only the surface of which is in contact with the surroundings. In contrast, lubricants are constantly circulated at continuous temperatures of for example 60 to 120° C., such that new surfaces are constantly being formed and coming into contact with the surroundings. Thermal and mechanical stresses are thus quite considerably severer than in plastics. It was not predictable that carbodiimides dramatically improve the stability of lubricant base materials even under these substantially harsher conditions and that only small quantities are required for this purpose.

The present invention provides lubricant base materials containing ester groups which contain as stabilisers 0.05 to 5 wt.%, preferably 0.1 to 3 wt.% of carbodiimide.

For the purposes of the invention, lubricant base materials are in particular long-chain carboxylic acid esters produced from mono- and polybasic, saturated and unsaturated, branched and unbranched, open-chain and cyclic aliphatic, substituted and unsubstituted mono- and polybasic aromatic carboxylic acids with mono- and polyhydric, saturated and unsaturated, branched and unbranched, open-chain and cyclic aliphatic, substituted, sterically hindered and unhindered as well as unsubstituted mono- and polyhydric aromatic alcohols. These include natural fats, oils and waxes, i.e. triglycerides of fatty acids and also synthetically produced esters, for example of methanol, 2-ethylhexanol, glycol, glycerol, trimethylolpropane (hereinafter abbreviated to TMP), pentaerythritol, neopentyl glycol with carboxylic acids such as, for example, steric acid, oleic acid, adipic acid, terephthalic acid and trimellitic acid. The alcohol components and carboxylic acids contain from 1 to 100, preferably from 1 to 36 carbon atoms.

Examples of suitable lubricant base materials based on organic acids and alcohols are: rapeseed oil methyl ester (hereinafter abbreviated to RME), refined rapeseed oil, trimethylolpropane trioleate (hereinafter abbreviated to TMP-oleate), diisotridecyl adipate.

Esters of inorganic acids with alcohols are also suitable lubricant base materials for the purposes of the invention. Examples of inorganic acids are phosphorous acid ($H_2PO_3$), phosphoric acid ($H_3PO_4$), phosphonic acid ($RP(OH)_3$), boric acid ($B(OH)_3$), silicic acid ($Si(OH)_4$), "silicone acid" ($R_2Si(OH)_2$) (R=hydrocarbon) and the oligomeric and polymeric anhydrides thereof. Alcohols may be mono- and polyhydric, saturated and unsaturated, branched and unbranched, open-chain and cyclic aliphatic as well as substituted and unsubstituted mono- and polyhydric aromatic. Examples of alcohols are methanol, ethanol, dodecanol, 2-ethylhexanol, isotridecyl alcohol, oleyl alcohol, isopropylphenol, nonylphenol and 2,4-dimethylphenol.

Examples of representatives of lubricant base materials based on inorganic esters are, for example, triisopropylphenyl phosphate, trinonylphenyl phosphate, tetraethyl silicate, diethyl polysilicate, dimethyl polysiloxane, silicones.

Another group of lubricant base materials for the purposes of the invention are olefin/dicarboxylic acid copolymers (trade name: Ketjenlube; manufacturer: AKZO).

Suitable carbodiimides are those of the formula (I)

$$(X)_m—[-N=C=N—Y—]_p—N=C=N—Y \quad (I)$$

in which

X and Y mean aromatic or araliphatic hydrocarbon residues with 6 to 20 C atoms, which bear aromatic, aliphatic and/or cycloaliphatic substituents with at least 2 C atoms in at least one ortho position relative to the carbodiimide group, preferably branched or cyclic aliphatic residues with at least 3 C atoms, and the carbodiimide group (s) is (are) attached to aromatic carbon, p is equal to 0 to 100, preferably 0 to 50 (on average), wherein X may still contain free isocyanate groups.

When p=0 and m=1, the above formula (I) can be shown as X—N=C=N—Y, wherein X and Y are as defined above. Preferred carbodiimides of the formula I are those having aromatic residues X and Y, for example phenyl, which are substituted in both ortho positions and optionally in para position relative to the carbodiimide groups by (cyclo)aliphatic and/or aromatic residues, for example $C_1$–$C_6$ alkyl or phenyl, wherein one of these substituents in ortho position may be a methyl group. Particularly preferred compounds are those having aromatic rings X and Y which are substituted in both adjacent positions relative to the carbodiimide group by (cyclo)aliphatic residues,, wherein one of these substituents-in ortho position may be a methyl group and the other contains at least 2 C atoms.

Very particularly preferred carbodiimides are those which bear 2 or 3 substituents in ortho or ortho and para position relative to the carbodiimide group, at least one of which is a branched aliphatic chain with at least 3 C atoms or a cycloaliphatic substituent with 5 or 6 C atoms. p is preferably 0 to 40.

The carbodiimides may be used as dimers, oligomeric or polymeric compounds or as mixtures thereof. Dimeric and polymeric carbodiimides (p≧11) are preferably used.

According to the invention, suitable substituents adjacent to the carbodiimide group on the aromatic ring are $C_2$–$C_{20}$ alkyl and/or cycloalkyl groups, such as ethyl, propyl, isopropyl, sec.-butyl, tert.-butyl, cyclohexyl, dodecyl or also aryl and aralkyl residues with 6 to 15 C atoms, such as phenyl, tolyl, benzyl, naphthyl residues etc..

Particularly suitable carbodiimides are those which are substituted by isopropyl in the ortho positions relative to the carbodiimide group, and which are optionally also substituted by isopropyl in para position relative to the carbodiimide group. The following carbodiimides are cited by way of example:

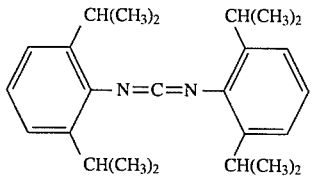

(1)

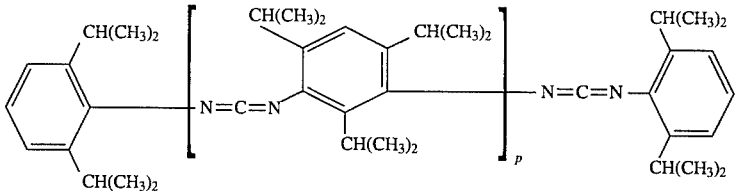

(2)

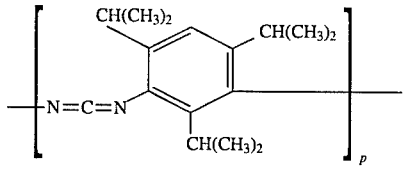

(3)

The carbodiimides of the formula (I) may be produced using per se known processes. One possible production process is described in DAS 25 37 685. According to the teaching of this patent, organic polyisocyanates are partially reacted to the desired degree in the presence of a suitable phosphorus compound and the catalyst is then deactivated with a suitable halide, for example an acid halide.

Polycarbodiimides, if they were produced from isocyanates, may moreover still contain reactive NCO groups and complexed monomeric isocyanates. Polycarbodiimides may, for example, be produced according to French patent 1 180 370 from polyisocyanates with catalytic quantities of phospholines, phospholidines and the oxides and sulphides thereof. Further suitable polycarbodiimides may be produced from aromatic di- and polyisocyanates, which bear one or two aryl, alkyl or aralkyl substituents in o-position relative to all NCO groups, wherein at least one of the substituents should have at least two carbon atoms, under the action of tertiary amines, basic-reacting metal compounds, carboxylic acid metal salts and non-basic organometallic compounds. Polycarbodiimides containing NCO groups may be modified by any isocyanate groups still present being removed with reactive compounds containing hydrogen, such as alcohols, phenols or amines (c.f. DE-AS 1 156 401 and DE-OS 2 419 968).

The stabilised lubricant base materials according to the invention may be produced by mixing the base materials with the carbodiimides in conventional mixing units.

The mixtures according to the invention may, for example, be used for the following applications: process oils, fuels, heat transfer oils, engine oils, fats, metal processing fluids and aviation turbine oils. The mixtures according to the invention are particularly suitable for power transmission fluids (hydraulic oils) and refrigeration oils.

The stabilised lubricant base materials according to the invention may be used in conjunction with neutral or alkaline anti-corrosion additives, for example calcium sulphonate (RC 4220, Rheinchemie Rheinau GmbH), amine and phenolic oxidation inhibitors, non-ferrous metal deactivators, wear and high pressure additives containing metal and without metal, together with setting point improvers, defoamers and demulsifiers, dispersants, detergents and viscosity index improvers.

Lubricant base materials containing ester groups—especially hydraulic oils are able to dissolve lead, zinc and tin contained in metal objects which are in contact with the oils. Such metal objects are e.g. bearings of pumps which can corrode so that they fail. The metals are extracted in this way from insoluble constituent, so that flow properties of the hydraulic oils are changed and filters in the stream of the oil are clogged. All these complications vanish upon addition of a carbodiimide as described above.

PRACTICAL EXAMPLES

Example 1

The mixtures according to the invention of carbodiimides with lubricant base materials were produced by simple mixing at approximately 50° C. These solutions were subjected to standardised lubricant tests and investigated with regard to hydrolysis resistance. The principal assessment criterion for these hydrolysis tests is the increase in acid value over the test period. The test methods and results are described below.

The carbodiimide used was N,N'-di (2.6-diisopropylphenyl) -carbodiimide, also named "Stabaxol 1".

TOST test ASTM-D 943 (DIN 51 587)

The TOST test is a constituent part of many different industrial oil specifications. The increase in acid value is monitored as an index of the ageing of the oil until the critical value of 2 mg KOH/g of oil is exceeded.

This increase is caused on the one hand by oxygen by means of a free-radical oxygen oxidation mechanism and, on the other hand, by water by means of hydrolysis (cleavage of the ester into acid and alcohols). In order to be able to evaluate these two influences separately, some tests involved the additional use of a mixture of ageing stabilisers and anti-corrosion products (hereinafter abbreviated to AO/CI combination), which, as is known, suppress oxygen ageing. It is clear from the table that by adding a carbodiimide (trade name: Staboxol 1; manufacturer: Rhein Chemie), the increase in acid value in the test oils in the presence of approximately 1.7% water may be substantially temporally retarded.

| | |
|---|---|
| Test conditions: | 300 ml oil → test substance<br>60 ml (distilled) water → hydrolysis<br>Cu coil → oxidation catalysts<br>Iron coil → oxidation catalysts<br>Oxygen, 3 1/h → oxidation<br>95° C. → exposure to heat |
| Assessment: | Time [h] until acid value >2 mg KOH/g |

TABLE 1

| Base oil | Additive | Concentration | Time until acid value >2 mg KOH/g [h] |
|---|---|---|---|
| Refined rapeseed oil | — | — | 24 h |
| Refined rapeseed oil | AO/CI combination | 2.3% | 48 h |
| Refined rapeseed oil | Stabaxol 1<br>AO/CI combination | 3%<br>2.3% | 168 h |
| TMP-oleate(1) | — | — | 24 h |
| TMP-oleate(1) | AO/CI combination | 1.5% | 64 h |
| TMP-oleate(1) | AO/CI combination<br>Stabaxol | 1.5%<br>2% | 192 h |
| TMP-ester(2) | — | — | 192 h |
| TMP-ester(2) | Stabaxol 1 | 1% | 1500 h |

TMP-oleate(1) = trimethylolpropane trioleate (trade name: Edenor TMP-05; manufacturer: Henkel KGaA)

TMP-ester(2) = trimethylolpropane ester with saturated $C_8/C_{10}$ acids (trade name: Edenor TMTC; manufacturer: Henkel KGaA)

ASTM-D 2619 ("Beverage bottle test" or also "Coca-Cola test")

This test is part of internationally recognised hydraulic oil specifications and is used to verify the hydrolysis resistance of fluids. The most important test criterion in ASTM-D 2619 is the increase in acid value in the aqueous phase.

| | |
|---|---|
| Test conditions: | 75 g oil → test substance<br>25 ml water → hydrolysis<br>Cu sheet → catalyst<br>93° C. → test temperature<br>48 h → duration of test (rotating bottles) |
| Assessment: | Increase in acidity of the aqueous phase on completion of test period. |

TABLE 2

Hydrolytic stabilisation of lubricant base materials with carbodiimides ASTM-D 2619 ("beverage bottle test" or "Coca-Cola test")

| Base fluid | Incorporated additives | Acidity [mg KOH/25 ml $H_2O$] |
|---|---|---|
| Refined rapeseed oil(1) | — | 3.5 |
| | 0.5% Stabaxol 1 | 0.7 |
| | 1% Stabaxol 1 | 0.5 |
| | 2% Stabaxol 1 | 0.35 |
| TMP-oleate(2) | — | 2.78 |
| | 1% Stabaxol 1 | 0.79 |
| TMP-ester(3) | — | 0.44 |
| | 1% Stabaxol 1 | 0.16 |
| | 2% Stabaxol 1 | 0.13 |
| Durad 220(4) | — | 4.0 |
| | +1% Stabaxol | 2.6 |
| | +2% Stabaxol | 2.4 |
| Tricresyl phosphate(5) | — | 29.9 |
| | 2% Stabaxol | 20.6 |

Refined rapeseed oil(1) = once refined rapeseed oil (synonym: colza oil)

TMP-oleate(2) = trimethylolpropane trioleate (trade name: Edenor TMP-05; manufacturer: Henkel KGaA)

TMP-ester(3) = trimethylolpropane ester with $C_8/C_{10}$ carboxylic acids (trade name: Edenor TMTC; manufacturer: Henkel KGaA)

Durad 220(4) = Sterically hindered, aromatic triarylphosphate ester (trade name: Durad 220; manufacturer: FMC)

Tricresyl phosphate(5) = tricresyl phosphate ester (trade name: Disflamoll TKP; manufacturer: Bayer AG)

The addition of carbodiimides to various lubricant base materials in each case results in a distinctly lower increase in acid value of the aqueous phase over the test period: the lubricant base materials are substantially more slowly decomposed by water in the presence of carbodiimides.

Example 2

The TMP-oleate(2) and the refined rapeseed oil(1) of Example 1 were subjected to a modified "Coca-Cola-test" (according to ASTM 2619).

Test conditions:

75 g oil→test substance 25 ml water→hydrolysis lead sheet→metal uptake

93° C.→test temperature 24 h→duration of test

The result is shown in table 3.

TABLE 3

| | TMP-oleate | TMP-oleate +1% by weight "Stabaxol 1" | rapeseed oil | rapeseed oil + 1% by weight of "Stabaxol 1" |
|---|---|---|---|---|
| weight loss of lead in mg | 117 | 10 | 94 | 7 |
| acid number at start mg KOH/g | 0.97 | 0.19 | 0.51 | 0.3 |
| acid number at | 2.83 | 0.07 | 2.98 | 0.16 |

TABLE 3-continued

| | TMP-oleate | TMP-oleate +1% by weight "Stabaxol 1" | rape-seed oil | rapeseed oil + 1% by weight of "Stabaxol 1" |
|---|---|---|---|---|
| the end of the test mg KOH/g | | | | |

Example 3

In a similar test as in Example 2 the uptake of metal was determined. The same TMP-oleate and refined rapeseed oil as in example 2 was used.

Test conditions:

Temperature: 60° C.

Amount of oil: 200 ml

Amount of water: 0

Duration of test: 336 h

The result is shown in Table 4:

| Oil | "Stabaxol" % by weight | metal | reduction in weight mg in 336 h | remarks |
|---|---|---|---|---|
| TMP-oleate | – | lead | –440 | – |
| TMP-oleate | 1 | lead | –1.8 | + |
| rapeseed oil | – | lead | –327 | – |
| rapeseed oil | 1 | lead | –1.5 | + |
| TMP-oleate | – | zinc | –250.4 | – |
| TMP-oleate | 1 | zinc | –1.8 | + |
| TMP-oleate | – | tin | –43.5 | – |
| TMP-oleate | 1 | tin | –1.4 | + |

– = turbid with precipitation
+ = clearly no precipitation

What is claimed is:

1. A lubricant base material selected from natural fats and oils containing as a stabilizer 0.05 to 5% by weight of a carbodiimide of the formula X—N=C=N—Y, wherein X and Y are aromatic residues with 6 to 20 carbon atoms.

* * * * *